United States Patent [19]

Mattox

[11] Patent Number: 4,789,154

[45] Date of Patent: Dec. 6, 1988

[54] NECK EXERCISE DEVICE

[76] Inventor: Ernest M. Mattox, 1638 Leonard, N.W., Grand Rapids, Mich. 49504

[21] Appl. No.: 816,131

[22] Filed: Jan. 3, 1986

[51] Int. Cl.[4] ..... A63B 23/00; A63B 21/00

[52] U.S. Cl. ..... 272/94; 272/93; 272/125; 272/127

[58] Field of Search ..... 272/93, 94, 135–143, 272/DIG. 9, 126, 127, 125, 119; 224/206

[56] References Cited

U.S. PATENT DOCUMENTS

| | | | |
|---|---|---|---|
| 420,179 | 1/1890 | Yagn . | |
| 440,684 | 11/1890 | Yagn . | |
| 497,774 | 5/1893 | Denison | 272/126 |
| 539,872 | 5/1895 | Kheiralla . | |
| 821,783 | 5/1906 | Clease . | |
| 966,562 | 8/1910 | Knoerzer | 224/266 |
| 1,123,570 | 1/1915 | Sandow . | |
| 1,265,083 | 5/1918 | Hoard . | |
| 1,308,675 | 7/1919 | Kelley . | |
| 2,160,722 | 5/1939 | Cunningham . | |
| 2,722,419 | 11/1955 | Tarapczynski . | |
| 2,791,999 | 5/1957 | Bustamante . | |
| 3,049,130 | 8/1962 | Fuschetti | 272/126 |
| 3,162,441 | 12/1964 | Karlik . | |
| 3,614,098 | 10/1971 | Carr . | |
| 3,820,781 | 6/1974 | Kane . | |
| 4,018,442 | 4/1977 | Galler . | |
| 4,057,246 | 11/1977 | Wilson . | |
| 4,219,193 | 8/1980 | Newman . | |
| 4,232,863 | 11/1980 | Roach . | |
| 4,245,840 | 1/1981 | Van Housen . | |
| 4,274,628 | 6/1981 | Hoagland . | |
| 4,319,747 | 3/1982 | Rogers . | |
| 4,335,875 | 6/1982 | Elkin . | |
| 4,337,938 | 7/1982 | Rodriquez | 272/DIG. 9 |
| 4,382,596 | 5/1983 | Silberman . | |
| 4,429,870 | 2/1984 | Gibbs . | |

FOREIGN PATENT DOCUMENTS

| | | | |
|---|---|---|---|
| 494526 | 7/1953 | Canada | 272/126 |
| 167621 | 2/1906 | Fed. Rep. of Germany . | |
| 1420610 | 2/1966 | France . | |
| 17279 | 12/1906 | Norway . | |

*Primary Examiner*—Richard J. Apley
*Assistant Examiner*—S. R. Crow
*Attorney, Agent, or Firm*—Price, Heneveld, Cooper, DeWitt & Litton;

[57] ABSTRACT

A neck exercise device that is used for isometric, isokinetic and isotonic exercises. The device includes a pair of aligned bars spaced by a joining bar, the aligned bars being bent so that the user may grasp the bars both in front of and to the rear of the body, thereby providing exercise for the back, front and sides of the neck. An elastic cord depends from the aligned bars, and alternatively the elastic cord is coupled to foot stirrups and then to handgrips for exercising with a walking-type motion.

26 Claims, 3 Drawing Sheets

NECK EXERCISE DEVICE

BACKGROUND OF THE INVENTION

The present invention relates to exercise equipment, and in particular to portable exercise devices used by individuals.

A wide variety of exercise equipment has been developed for working most areas of the human body. Of these, many early pieces of exercise equipment utilized freestanding weights and the like, and were each used for a wide range of different exercises that worked various different muscle groups. The subsequent development of more complex exercise machines has generally been directed to a limiting of the number of muscle groups or areas of the body worked by each individual piece of equipment, but these more specific, complex machines arguably result in a more thorough or safer working of each specific muscle group. As a result, a number of relatively complex and expensive machines have been developed which cumulatively exercise most areas of the human body. Although such equipment is normally quite effective, the size, complexity and expense of such equipment is prohibitive for most individuals, resulting in such equipment normally being acquired and used at health clubs and the like.

A number of other less complex exercise apparatus have also been developed that are intended to work particular muscle groups or areas of the body. One such general class or type of apparatus include bars, harnesses or the like which are worn about the user's shoulders in order to provide added weight or resistance while doing various exercises. Although such devices may be used either alone or in conjunction with other weights in various bending and stretching exercises, one muscle group or area that receives less attention than others is that of the neck. Since the neck is not normally used directly in most sporting events, it is quite often overlooked in individuals' exercise regimes. Nonetheless, mobility of a person's neck is required in almost every athletic endeavor, as well as in most other daily activities. As a result, the neck quite often becomes a location for fatigue or the storage of tension long before other areas of the body.

SUMMARY OF THE INVENTION

The present invention provides an exercise device that is useful for a wide range of isometric, isokinetic and isotonic exercises. The exercise device includes a pair of generally aligned bars that are connected so as to be positionable around the neck of a user. These aligned bars operate as levers so that a bearing surface on the joining member may be forced against the user's neck while the user controls this force with his hands. The aligned bars each include a bend that permit the device to be positioned and grasped either forward or to the rear of the user, and thus enables the user to exercise the front, back and both sides of the neck. In another embodiment, elastic cords depend from the aligned bars in order to be grasped and provide a resistance to neck movement that is derived from the spring force of the cords. These elastic cords alternatively depend to stirrups for the user's feet and then up to handgrips in order to provide additional exercises derived from a walking-type motion.

These and other objects, features and results of the invention will be recognized from the specification and claims which follow and the drawings included herewith.

DETAILED DESCRIPTION OF THE PREFERRED EMBODIMENT

Figure 1:
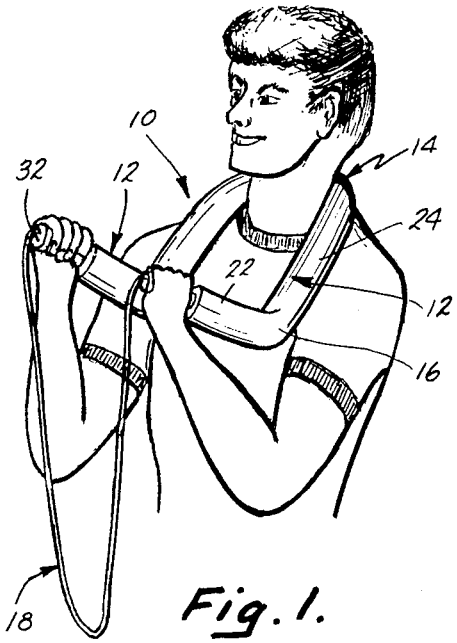
FIG. 1 is a fragmentary, perspective view of an exercise device embodying the present invention, shown in use with the handles located forward of the user's body in order to exercise the back of the neck.

An exercise device embodying a preferred form of the invention is illustrated in the drawings and is generally designated in FIG. 1 by the reference numeral 10. Device 10 includes a pair of spaced and aligned bars 12 that are interconnected by a joining bar 14. Joining bar 14 spaces aligned bars 12 so as to be adapted for fitting around the neck of a person and to extend either to the front or to the rear of the user. Each aligned bar 12 includes a bend 16 that provides exercise device 10 with the ability to be grasped either forward or to the rear of the body. Exercise device 10 is used to exercise the back of the neck (FIG. 1), the front of the neck (FIG. 4) and either side of the neck (FIG. 5). An elastic cord 18 depends from the ends of aligned bars 12. Elastic cord 18 is grasped (FIG. 6) in order to exert a force on the user's neck directly related to the spring force of elastic cord 18, and thus provide an isotonic exercise for the neck. Device 10 therefore provides for the isometric, isokinetic and isotonic exercising of the user's neck.

Figure 2:
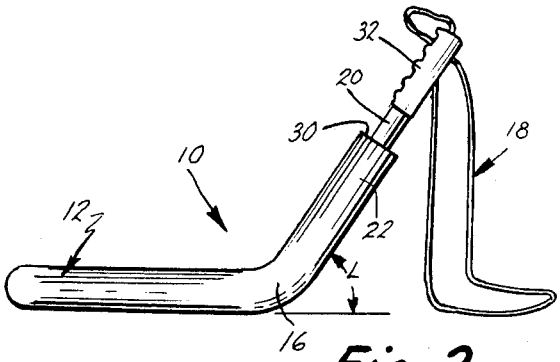
FIG. 2 is a side elevational view of the exercise device shown in FIG. 1.
Figure 3:
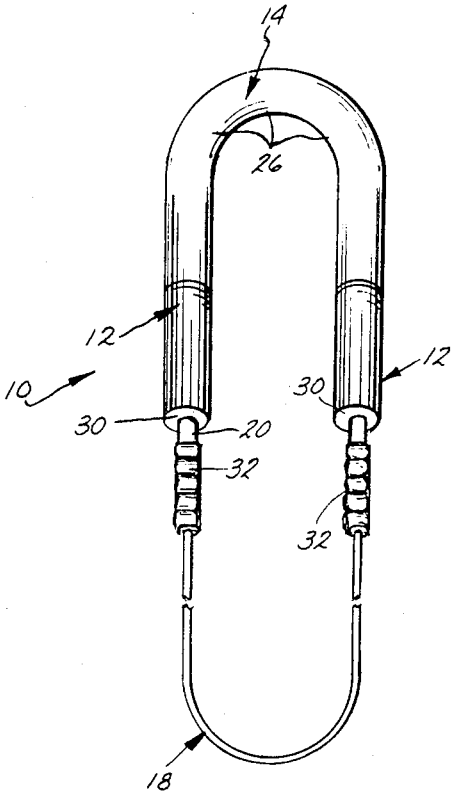
FIG. 3 is a top plan view of the exercise device shown in FIG. 1.

Aligned bars 12 and joining bar 14 are formed from a unitary length of steel tubing 20 (FIGS. 2–3) having a diameter of approximately one inch that is bent to the desired configuration. As shown in FIG. 2, bends 16 are smoothly curved and divide each aligned bar 12 into a cantilevered lever section 22 that extends from a joined or base section 24. Lever sections 22 extend away from the plane of base sections 24 in order to define a lever angle "L" (FIG. 2) with the plane of base sections 24. Lever angle "L" preferably is greater than forty-five degrees, and most preferably is in a range around about sixty degrees, so that lever sections 22 and base sections 24 themselves define an angle of about one hundred-twenty degrees. Preferably base sections 24 are approximately nine inches long from a tangent to joining bar 14 to the start of bend 16. Base sections 22 are preferably approximately seventeen and one-half inches long from the plane of base sections 24, following the curve of bends 16 to the free ends. When exercise device 10 is positioned about a person's neck, lever sections 22 may be grasped relatively easily by the person using device 10.

Joining bar 14 is a smoothly curved semicircular section that spaces aligned bars 12 so as to be adapted to the width of a person's neck. Curved joining bar 14 preferably has a curve diameter of about seven and one-half inches and therefore aligned bars 12 are spaced that distance adjacent joining bar 14. Aligned bars 12 wedge outwardly or diverge slightly from joining bar 14, so that the free ends of aligned bars 12 are preferably spaced approximately eight and one-half inches. This outward wedging or diverging of aligned bars 12 provides a funneling effect for the neck of a person as it is inserted between aligned bars 12, and therefore makes placement of exercise device 10 about the neck easier, particularly for persons with large or developed necks. The term "aligned bars" as used herein refers to the extension of bars 12 to the same side of joining bar 14 and the general alignment of aligned bars 12 in elevational view shown in FIG. 2. The term "aligned bars" as used herein encompasses the outward wedging or diverging of aligned bars 12. Alternatively, aligned bars 12 may extend generally parallel to each other, and will therefore be additionally "aligned" in this fashion.

About the inner circumference of joining bar 14 is a bearing surface 26 (FIG. 3) that extends a short distance along aligned bars 12. Bearing surface 26 contacts the neck of the person during use and therefore has a surface texture and configuration that is comfortable when brought into contact with the neck of the user. Joining bar 14 and aligned bars 12 include an elastomeric padding 30 around steel tubing 20 to provide such a comfortable bearing surface 26. Elastomeric padding 30 is preferably a sleeve of polyurethane or polyethylene foam material having an outside diameter of approximately two and three-eighths inch, although other elastomeric or padding materials may be suitably employed. A grip or handle 32 is fitted over each end of steel tubing 20 in order to form a handhold at the end of lever sections 22.

Elastic cord 18 is a resilient rubber or polymeric material such as surgical tubing. Preferably elastic cord 18 is a surgical rubber tubing ranging between approximately five-sixteenths and one-half inch in diameter, although other suitable resilient material may be employed. When exercise device 10 is used for variable isotonic exercises as described below, the force applied by the device is related to the elastic spring constant of elastic cord 18. This force may thus be varied by varying either the diameter of elastic cord 18 or the material used therein.

Exercise device 10 is used to perform either isometric, isotonic or isokinetic exercises on the neck of the user. As shown in FIG. 1, device 10 is fitted about the neck of the user so that aligned bars 12 extend forward of the body, with lever sections 22 angling slightly upward. Handles 32 are grasped so that base sections 24 form a fulcrum against the shoulders and bearing surface 26 is forced against the neck. In this fashion, exercise device 10 may be used for either isometric or isokinetic exercising of the back of the neck.

An isometric working or contraction occurs when a muscle attempts to shorten but is unable to overcome an opposing resistance. With exercise device 10 held stationary and a force exerted against the neck, the neck is isometrically worked by pressing against this force without moving exercise device 10. An isokinetic working or training occurs when a muscle works against a resistance but movement is permitted at a preselected fixed speed, thus enabling the muscle to mobilize its maximum working capacity throughout the full range of movement. With exercise device 10 grasped by handles 32 and the applied force controlled by the user to permit movement of exercise device 10 at a constant speed, exercise device 10 provides an isokinetic working of the neck. In controlling the rate of movement so as to remain constant, the user varies the force exerted against the neck through the range of motion.

Figure 4:
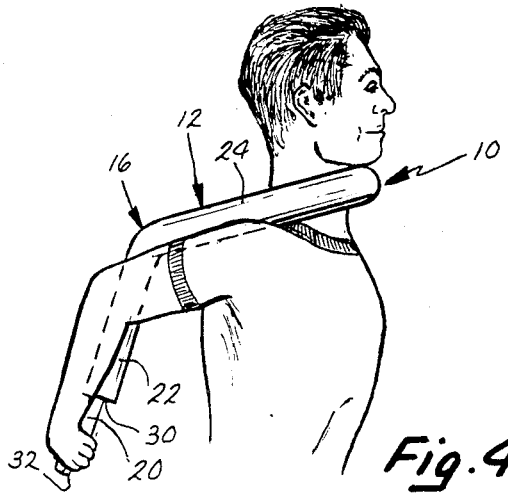
FIG. 4 is a fragmentary side elevational view of the exercise device of FIG. 1, shown in use with the handles located to the rear of the user's body in order to exercise the front of the neck.
Figure 5:
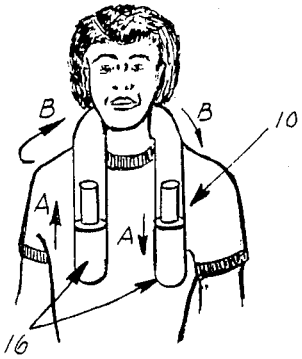
FIG. 5 is a fragmentary, front elevational view of the exercise device of FIG. 1, shown in use in order to exercise the sides of the neck.

As shown in FIG. 4, exercise device 10 is positioned about the neck so that aligned bars 12 protrude to the rear of the body, with lever sections 22 depending slightly downwardly. Handles 32 are grasped behind the torso relatively easily in order to provide either isometric or isokinetic exercising of the front of the neck. With exercise device 10 positioned about the neck as shown in FIG. 1, the user may also exercise the sides of the neck as shown in FIG. 5. When a counteracting upward and downward force is applied to opposite handles 32 as indicated in FIG. 5 by Arrows A, bearing surface 26 applies a force against the sides of the neck as indicated by Arrows B of FIG. 5. Alternatively, the same exercise may be performed with exercise device 10 inverted so that handles 32 extend down the torso of the user.

Figure 6:
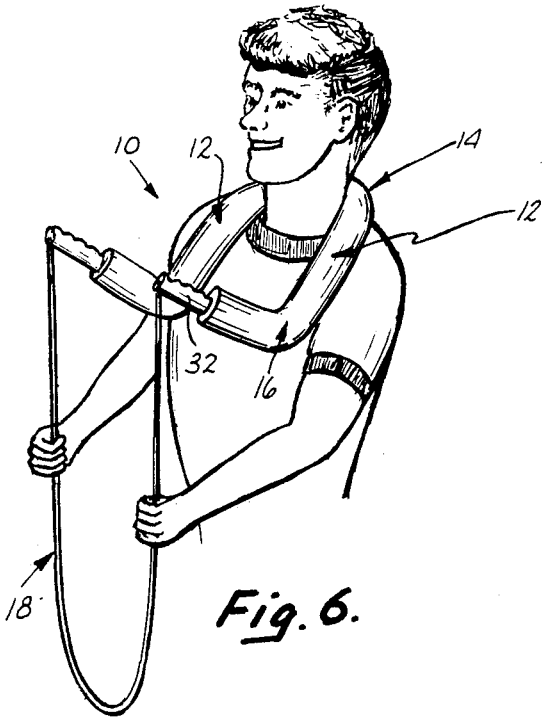
FIG. 6 is a fragmentary perspective view of the exercise device of FIG. 1, shown in use with the handles located in front of the user's body and the elastic cords depending therefrom being grasped to provide an isotonic exercise to the rear of the neck.

As shown in FIG. 6, with device 10 positioned so that bars 12 extend forward of the body, the depending lengths of elastic cord 18 may be readily grasped in front of the body. When elastic cord 18 is stretched slightly, the spring force of elastic cord 18 generates a force against the neck that permits the user to perform isotonic exercises. An isotonic exercise or training occurs when a muscle works against an external load or resistance that remains constant throughout the movement. With elastic cord 18 grasped as in FIG. 6, the spring force or resistance will be a product of the constant elastic properties of the cord material, and therefore the resistance will approach an isotonic resistance. Of course, the spring force will to some degree be related to the amount of stretch in elastic cord 18 and therefore will vary through the range of movement of exercise device 10 but will still retain isotonic exercise properties. Isotonic exercises can be performed with exercise device 10 positioned at various orientations on the neck. Alternatively elastic cord 18 may be severed into two separate lengths and still perform this function, or elastic cord 18 may span the gap between handles 32 to provide a circle of elastic material.

A pair of short sleeves or collars may alternatively be slid onto aligned bars 12 to a position just forward of the shoulders when in the at-rest position. The collars have a tapered, conical shape to form stops that maintain the correct position of device 10 while in use.

Figure 7:
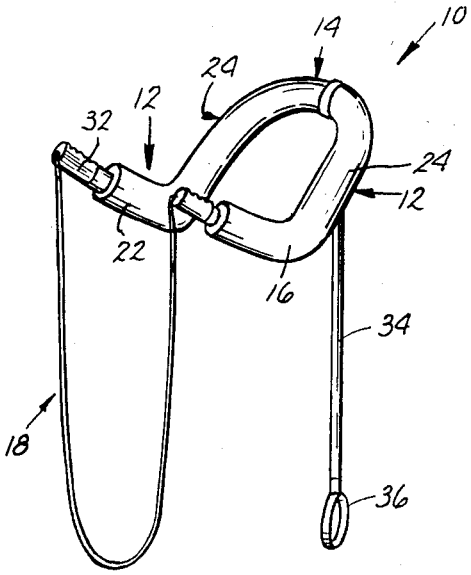
FIG. 7 a perspective view of a second embodiment of the device.

The embodiment shown in FIG. 7 is similar to that shown in FIGS. 1–6, with the addition of a tension control strap 34 that is connected to joining bar 14. Tension control strap 34 hangs down behind the user's back when exercise device 10 is positioned about the user's neck in the same orientations as is shown in FIG. 6. At the lower end of strap 34 is a looped hand grip 36 which may be grasped behind the user's back. Tension control strap 34 is used to vary the force exerted against the user's neck. In use, elastic cord 18 is looped underneath the user's feet so that a resilient force is exerted by joining bar 14 against the back of the user's neck. The force may be varied by spreading the placement of the feet. The user grasps grip 36 in order to relieve some of the pressure produced by elastic cord 18. The user then rotates his head in a circular motion which rotates handles 32 in a similar circular motion. Since lever sections 22 extend forward of the body, as handles 32 travel in this circular pattern the range of resilient force exerted by elastic cord 18 is amplified. Alternatively, the user may move his neck in a forward and backward motion while relieving some of the resilient spring force with tension control strap 34.

Figure 8:
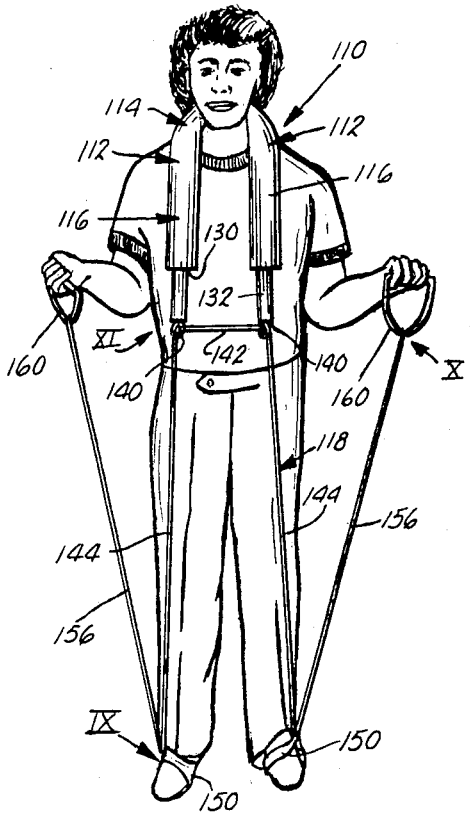
FIG. 8 is a front elevational view of a third embodiment of the device shown in use.

Another embodiment is shown in FIG. 8 and referenced generally by the numeral 110. Exercise device 110 is similar to device 10 with the exception of those features noted below. Common features have therefore been given the same reference numeral, with the exception of a prefix one hundred. Exercise device 110 includes a pair of aligned bars 112 that are connected by a joining bar 114. Each aligned bar 112 includes a bend 116 that defines a lever section and a base section. Device 110 has an elastomeric padding 130 that provides a comfortable bearing surface about joining bar 114 and aligned bars 112, and a handle 132 is located on the end of each aligned bar 112.

Figure 9:
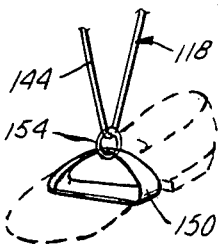
FIG. 9 is a fragmentary, perspective view of the stirrup region of the exercise device of FIG. 8, taken in the region of Arrow IX.
Figure 11:
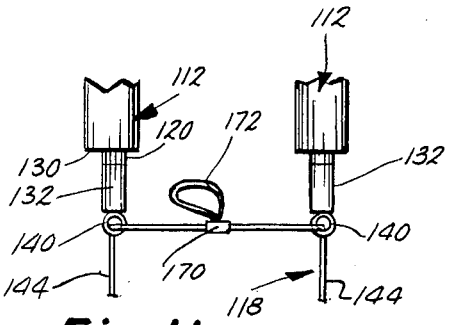
FIG. 11 is a fragmentary, front elevational view of the middle torso mounting region of the exercise device of FIG. 8, taken in the region of Arrow XI.

As shown in FIG. 8, a cord anchoring ring 140 is connected to the end of each aligned bar 112. Anchoring rings 140 provide an adjustable mounting for elastic cord 118, which extends between rings 140 in a spanning length 142 (FIG. 11). Elastic cord 118 extends don to the feet of the user in a pair of depending lengths 144. A stirrup 150 (FIG. 9) is fitted around the foot of the user. Stirrup 150 is a flat band of flexible fabric that is stitched into a loop so as to lie flat beneath the foot of the user. Elastic cord 118 is slidably adjustably received through a foot anchoring ring 154 that adjustably couples elastic cord 118 and stirrup 150.

Figure 10:
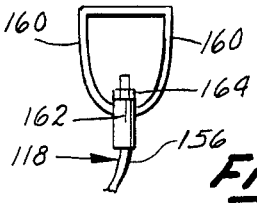
FIG. 10 is a fragmentary, front elevational view of a handhold for the exercise device of FIG. 8, taken in the region of Arrow X.

An upwardly extending length 156 of elastic cord 118 extends from each foot stirrup 150 up to a handgrip 160. Elastic cord 118 therefore forms a general "W" configuration that extends upwardly from foot stirrups 150 to the torso region of the person using exercise device 110 and also up to the hands of the user. Two adjustments are alternatively provided for the length of cord 118. As shown in FIG. 10, upwardly extending length 156 is received through a channel 162 on the base of handgrip 160. A clip 164 clamps onto the exposed end of elastic cord 118 in order to prevent the retraction of cord 118 through channel 162. Clip 164 is adjustable along the length of elastic cord 118 in order to provide for the shortening or lengthening of cord 118 overall. Alternatively, elastic cord 118 may include two separate sections of material, each section anchored to the end of one aligned bar 112 and extending in a single depending length 144 and upwardly extending length 156.

An alternative length adjustment mechanism is shown in FIG. 11. A clip 170 is clamped over spanning length 142 between anchoring rings 140 in order to take up a loop 172 of excess cord material. The length of cord 118 may therefore be adjusted by taking up lengths of cord between aligned bars 112, rather than at handgrips 160.

Exercise device 110 may be used in the manner described above in relation to exercise device 10 for working various areas of the neck. Handles 132 are grasped as described above for various neck exercises and depending lengths 144 of elastic cord 118 are grasped for various other exercises. Additionally, exercise device 110 may be used for exercises that utilize a walking-type motion. With exercise device 110 positioned around the neck as shown in FIG. 8 with stirrups 150 over the user's feet, a resilient force will be generated that is exerted between the neck and the feet as the person walks. This walking motion therefore works the legs, torso and neck of the user, rather than simply the user's legs. Since the elastic cord 118 also extends up to handgrips 160, a resilient force is also generated that is exerted between the feet and hands of the user. A walking motion will therefore be applied against both the arms and upper torso of the user. Exercise device 110 may be alternatively used for various other exercises. For example, if the user remains stationary and handgrips 160 are raised, a similar resilient force is exerted against the neck and hands of the user due to the sliding coupling of elastic cord 118 through foot mounting rings 154. These and various other exercises may be performed using the exercise device disclosed herein.

Figure 12:
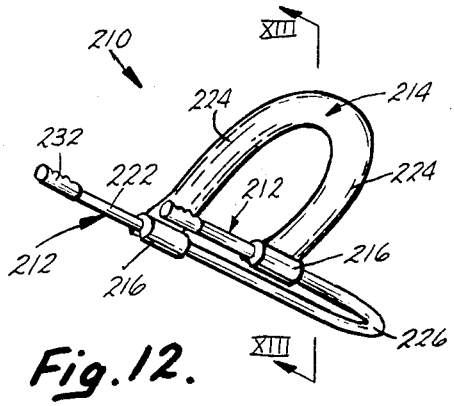
FIG. 12 is a perspective view of a fourth embodiment of the device.
Figure 13:
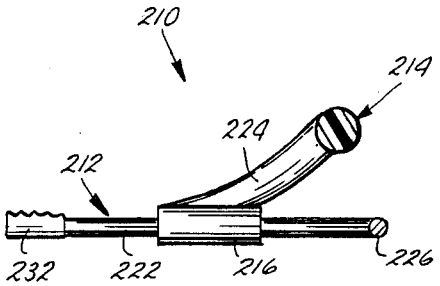
FIG. 13 is an elevational, sectional view taken along plane XII of the device of FIG. 12.

Another embodiment is shown in FIG. 12 and referenced generally by the numeral 210. Exercise device 210 is similar to device 10 with the exception of those features noted below. Common features have therefore been given the same reference numeral, with the exception of a prefix two hundred. Exercise device 210 includes a pair of aligned bars 212 that are connected by a joining bar 214. Joining bar 214 is removably connected to aligned bars 212 by a pair of snap-fit connectors 216. A section of aligned bars 212 extend forward of connectors 216 to form lever sections 222, while a base section 224 extends between joining bar 214 and connectors 216.

Aligned bars 212 are formed from a single length of metal rod bent to form a curved end bar 226. Joining bar with base sections 224 are formed as an integral unit from a material having sufficient rigidity to provide resistance against the user's neck. Alternatively, an elastomeric cushioning material can extend around joining bar 214 in order to provide a comfortable bearing surface. Connectors 216 resiliently snap around aligned bars 212, but may be secured to aligned bars 212 so as to be nonremovable. A pair of handles 232 are located on the free ends of aligned bars 212.

Alternatively, joining bar 214 and base sections 224 are made from a stiff spring element having a suitable covering padding material. The provision of the spring permits exercise device 210 to flex during use and therefore the force exerted will be in part determined by the spring force of the joining bar 214 and base sections 224.

Figure 14:
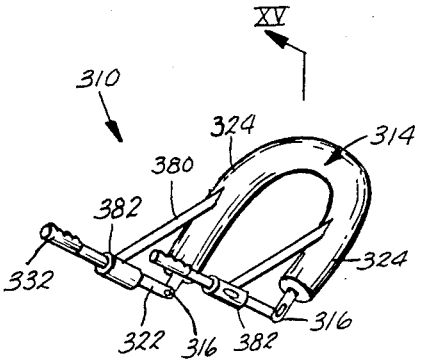
FIG. 14 is a perspective view of a fifth embodiment of the device.
Figure 15:
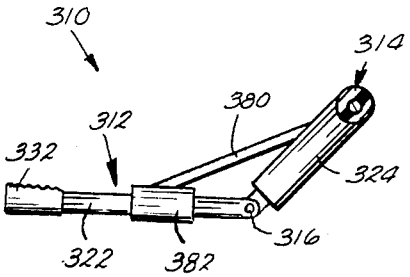
FIG. 15 is an elevational, sectional view taken along plane XV—XV of FIG. 14.

Shown in FIG. 14 is an adjustable neck exercise device forming another embodiment referenced generally by the numeral 310. Exercise device 310 is similar to device 10 with the exception of those features noted below. Common features have therefore been given same reference numeral, with the exception of a prefix three hundred. Device 310 includes a pair of aligned bars 312 that are connected by a joining bar 314. A pair of pivots 316 define an adjustable lever angle between lever sections 322 and base sections 324. Joining bar 314 and base sections 324 are padded to provide a comfortable bearing surface against the user's neck and shoulders. Pivots 316 are provided with a suitable locking fastener, such as a wing nut, clamp or the like, in order to lock the lever angle defined between lever sections 322 and base sections 324. The lever angle is therefore adjustable as desired by the user.

Exercise device 310 is also provided with an alternative mechanism for setting the lever angle defined by pivots 316. The alternative angle setting mechanism includes a pair of elastic straps 380 that are secured to base sections 324. Elastic straps 380 extend to a pair of collars 382 that slide along base sections 322. Collars 382 are provided with an appropriate fastener, such as a hand-tightened bolt or the like that sets collars 382 in a selected position on lever sections 322. Elastic straps 380 provide a resilient adjustment of the lever angle defined by pivot 316 as a person draws down on handles 332. When exercise device 310 is used with pivots 316 unlocked, the force exerted against the user's neck results from the elastic force of straps 380, permitting the lever angle to flex during use.

Figure 16:
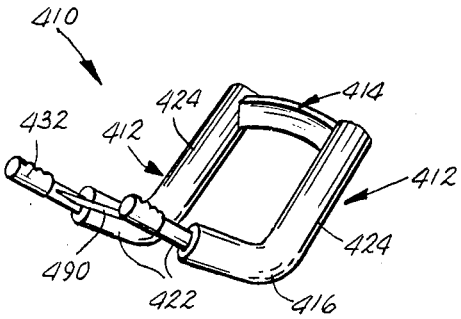
FIG. 16 is a perspective view of a sixth embodiment of the device.

Still another embodiment is shown in FIG. 16 and referenced generally by the numeral 410. Exercise device 410 is similar to device 10 with the exception of those features noted below. Common features have therefore been given the same reference numeral, with the exception of the prefix four hundred. Exercise device 410 includes a pair of aligned bars 412 that are connected at one end by an elastic band 414 that forms a resilient joining member. Aligned bars 412 include a pair of bends 416 that define lever sections 422 and base sections 424. A pair of handles 432 are located on the ends of aligned bars 412 opposite elastic band 414. A spacing bar 490 connects lever sections 422 in order to maintain the outwardly wedged orientation of aligned bars 412. Spacing bar 490 is located close enough to handles 432 to permit base sections 412 to be slid around the user's neck. Alternatively, the person using device 410 maintains the appropriate orientation of aligned bars 412, in which case spacing bar 490 may be deleted.

It is to be understood that the above is merely a description of the preferred embodiments and that one skilled in the art will recognize that various modifications or improvements may be made without departing from the spirit of the invention disclosed herein. The scope of protection afforded is to be determined from the claims which follow and the breadth of interpretation which the law allows.

In the embodiments of the invention in which an exclusive property or privilege is claimed are as follows:

1. A neck exercise device, comprising:

a pair of generally aligned lever bars each having a first end section lying in a first common plane and a second end section extending from said first end section;

a joining member joining said first end sections and spacing said lever bar so as to accommodate the neck of a person therebetween and said first end sections having a fulcrum surface thereon, said joining member providing a neck bearing surface thereon, and said second end sections providing handholds thereon; and said second end sections extending out of said first common plane of said first end sections in a second common plane, and said second end sections adapted such that when said neck bearing surface contacts one side of the neck of a person and said fulcrum surfaces of said first end sections contact the shoulder region of said person, said second end sections extent outwardly from the torso of the person from the side of the neck opposite said joining member, whereby said lever bars are provided with the ability to be grasped and pivoted about said fulcrum surfaces to force said joining member against the neck for exercise therewith.

2. The neck exercise device of claim 1, wherein:

said second end sections form a lever angle with the plane of said first end sections greater than approximately forty-five degrees.

3. The neck exercise device of claim 2, wherein:

said lever angle is in a range about sixty degrees.

4. A neck exercise device, comprising:

a pair of generally aligned lever bars each having a first end section lying in a common plane and a second end section extending from said first end section;

a joining member joining said first end sections and spacing said lever bar so as to accommodate the neck of a person therebetween, said joining member providing a neck bearing surface thereon, and said second end sections providing handholds thereon;

said second end sections extending out of said common plane of said first end sections, and said second end sections adapted such that when said neck bearing surface contacts one side of the neck of a person said second end sections extend outwardly from the opposite side of the neck; and a flexible cord element depending from each of said second end sections, whereby said lever bars and said flexible cord elements are provided with the ability to be grasped and apply a lever force against the neck through said neck bearing surface.

5. The neck exercise device of claim 4, wherein:

said flexible cord elements are elastomeric elements.

6. The neck exercise device of claim 5, further comprising:

means for securing said elastomeric cord elements to the feet of a person using said neck exercise device.

7. The neck exercise device of claim 6, further comprising:

a pair of handgrips, said elastomeric cord elements extending from said securing means to said handgrips.

8. The neck exercise device of claim 4, further comprising:

means for securing said flexible cord elements to the feet of a person using said neck exercise device.

9. The neck exercise device of claim 8, further comprising:

a pair of handgrips, said flexible cord elements extending from said securing means to said handgrips.

10. The neck exercise device of claim 1, wherein said joining member is a joining bar, said first end sections and said joining bar having elastomeric padding thereon.

11. The neck exercise device of claim 1, wherein: said aligned bars diverge from said joining member.

12. The neck exercise device of claim 1, wherein: said joining member is resilient.

13. A neck exercise device, comprising:

a pair of generally parallel aligned bars, said aligned bars being interconnected and spaced by a joining member so as to accommodate the neck of a person therebetween;

said aligned bars each including bends therein that define a base section and a lever section thereof, said lever sections being spaced by said base sections from said joining member;

a handhold on each of said lever sections;

an elastic cord depending from said lever sections; and said aligned bars have fulcrum surfaces for engaging the user's shoulder region and are adapted to extend around the neck of a user with said joining member disposed behind the neck and said handholds disposed forward of the user such that said handholds are positioned and adapted to be grasped and pulled downwardly to pivot said joining member against the neck, and said elastic cord is adapted to be pulled downwardly to pivot said joining member against the neck.

14. The neck exercise device of claim 13, further comprising:

means for coupling said elastic cord to the feet of a person using said exercise device.

15. The neck exercise device of claim 14, further comprising:

a pair of handgrips, said elastic cord extending from said feet coupling means to said handgrips.

16. A neck exercise device, comprising:

a pair of generally parallel aligned bars, said aligned bars being interconnected and spaced by a joining member so as to accommodate the neck of a person therebetween;

said aligned bars each including bends therein that define a base section and a lever section thereof, said lever sections being spaced by said base sections from said joining member;

a handhold on each of said lever sections;

said aligned bars have fulcrum surfaces for engaging the user's shoulder region and are adapted to extend around the neck of a user with said joining member disposed behind the neck and said handholds disposed forward of the user such that said handholds are positioned and adapted to be grasped and pulled downwardly to pivot said joining member against the neck; and said aligned bars extending divergently from said joining member.

17. A neck exercise device, comprising:

a pair of generally aligned bars each having a first end and a second end;

a joining member connecting and spacing said first ends of said aligned bars so as to accommodate the neck of a person therebetween, said joining member including a neck bearing surface thereon;

a resilient flexible member coupled to said second ends, said neck exercise device being adapted such that a downward force on said resilient flexible member resiliently forces said joining member against the neck of a person using said neck exercise device whereby said aligned bars have fulcrum surfaces for engaging the user's shoulder region for pivotally forcing said joining member against the neck of the user;

means for coupling said resilient flexible member to the lower limbs of the person using said neck exercise device; and said resilient flexible member including means for adjusting the length thereof.

18. A neck exercise device, comprising:

a pair of generally aligned bars each having a first end and a second end;

a joining member connecting and spacing said first ends of said aligned bars so as to accommodate the neck of a person therebetween, said joining member including a neck bearing surface thereon;

a resilient flexible member coupled to said second ends, said neck exercise device being adapted such that a downward force on said resilient flexible member resiliently forces said joining member against the neck of a person using said neck exercise device;

means for coupling said resilient flexible member to the lower limbs of the person using said neck exercise device, whereby said aligned bars have fulcrum surfaces for engaging the user's shoulder region for pivotally forcing said joining member against the neck of the user.

19. A neck exercise device, comprising:

a pair of generally aligned bars each having a first end and a second end;

a joining member connecting and spacing said first ends of said aligned bars so as to accommodate the neck of a person therebetween, said joining member including a neck bearing surface thereon;

a resilient flexible member coupled to said second ends;

means for coupling said resilient flexible member to the feet of the person using said neck exercise device;

a pair of handgrips, said resilient flexible member extending from said feet coupling means to said handgrips, whereby said aligned bars have fulcrum surfaces for engaging the user's shoulder region for pivotally forcing said joining member against the neck of the user.

20. The neck exercise device of claim 19, wherein: said resilient flexible member is slidably coupled with said second ends of said aligned bars.

21. A neck exercise device, comprising:

a pair of generally aligned bars each having a first end and a second end;

a joining member connecting and spacing said first ends of said aligned bars so as to accomodate the neck of a person therebetween, said joining member including a neck bearing surface thereon;

a resilient flexible member coupled to said second ends, said neck exercise device being adapted such that a downward force on said resilient flexible member resiliently forces said joining member against the neck of a person using said neck exercise device whereby said aligned bars have fulcrum surfaces for engaging the user's shoulder region for pivotally forcing said joining member against the neck of the user;

a pair of handgrips, said resilient flexible member extending to said handgrips; and said resilient flexible member including means for adjusting the length thereof.

22. The neck exercise device of claim 21, wherein:

said adjusting means is located between said aligned bars.

23. The neck exercise device of claim 17, wherein:

said aligned bars each include a bend thereon such that said first end and said second end define an angle therebetween of less than one hundred eighty degrees.

24. The neck exercise device of claim 23, wherein:

each said first end and said second end define an angle therebetween of approximately one hundred twenty degrees.

25. The neck exercise device of claim 23, wherein:

said aligned bars are divergent.

26. A neck exercise device, comprising:

a pair of lever bars coupled together at a set of first ends and extending to a set of second ends, each said second end having a handhold thereon and said first ends having a neck bearing surface thereon;

a pair of shoulder bearing surfaces disposed beneath said lever bars and adapted to rest on the shoulder region of a user and form fulcrum surfaces thereat when said lever bars are positioned about the neck of a user; and a lever moment arm defined between each of said fulcrum surfaces and said handholds, a neck moment arm defined between each of said fulcrum surfaces and said neck bearing surface, said neck moment arms lying in a first common plane and said lever moment arms extending in a second common plane out from said first common plane of said neck moment arms and said lever moment arms extending away from the torso of a person using said neck exercise device, whereby when said neck exercise device is positioned around the neck of a user with said handholds positioned forward of the user, said handholds may be grasped and pulled downwardly to pivot said neck exercise device about said fulcrum surfaces and force said neck bearing surface against the user's neck.

* * * * *

UNITED STATES PATENT AND TRADEMARK OFFICE

CERTIFICATE OF CORRECTION

PATENT NO. : 4,789,154

DATED : December 6, 1988

INVENTOR(S) : Ernest M. Mattox

It is certified that error appears in the above-identified patent and that said Letters Patent is hereby corrected as shown below:

Column 5, Line 49
"don" should be "down".

Column 8, Claim 1, Line 15
"extent" should be "extend".

Signed and Sealed this

Thirtieth Day of May, 1989

*Attest:*

*Attesting Officer*

DONALD J. QUIGG

*Commissioner of Patents and Trademarks*